US011123979B2

(12) United States Patent
Noterman

(10) Patent No.: US 11,123,979 B2
(45) Date of Patent: Sep. 21, 2021

(54) PRINTABLE FILM LAYER WITH CARRIER LAYER AND METHOD OF USE

(71) Applicant: Christian Carter Noterman, Westminster, CA (US)

(72) Inventor: Christian Carter Noterman, Westminster, CA (US)

( * ) Notice: Subject to any disclaimer, the term of this patent is extended or adjusted under 35 U.S.C. 154(b) by 0 days.

(21) Appl. No.: 16/594,487

(22) Filed: Oct. 7, 2019

(65) Prior Publication Data

US 2021/0107276 A1 Apr. 15, 2021

Related U.S. Application Data

(63) Continuation-in-part of application No. 16/008,741, filed on Jun. 14, 2018, now Pat. No. 10,434,762.

(60) Provisional application No. 62/520,955, filed on Jun. 16, 2017.

(51) Int. Cl.

| | |
|---|---|
| ***B41J 5/50*** | (2006.01) |
| ***B41J 3/407*** | (2006.01) |
| ***B41J 2/005*** | (2006.01) |

(52) U.S. Cl.

CPC ..... *B41J 2/0057* (2013.01); *B41J 3/407* (2013.01)

(58) Field of Classification Search

CPC .... B41J 2/0057; B41J 3/4073; B41M 5/0011; B41M 5/502

See application file for complete search history.

(56) References Cited

U.S. PATENT DOCUMENTS

| | | | | |
|---|---|---|---|---|
| 2014/0212615 | A1* | 7/2014 | Norgaard | B42D 5/027 428/42.1 |
| 2017/0243523 | A1* | 8/2017 | Potter | B31D 1/021 |
| 2017/0259604 | A1* | 9/2017 | Bland | B29C 48/21 |
| 2018/0319141 | A1* | 11/2018 | Mitchell | B32B 27/18 |

* cited by examiner

*Primary Examiner* — Scott A Richmond

(74) *Attorney, Agent, or Firm* — Eric Hanscom

(57) ABSTRACT

Described herein is a printing template for use during an aqueous inkjet printing process in which ink is transferred onto a printable layer. The printing template includes a printable layer having a first side, a second side opposite the first side, and a shaped perimeter, the first side defining a printable surface. The printing template further includes a carrier layer sized and configured to entirely encompass the shaped perimeter of the printable layer. The carrier layer includes a first side and a second side opposite the first side. The first side includes an adhesive coating causing the first side of the carrier layer securely associated with the second side of the printable layer during the printing process, and is thereafter allowing removal of the carrier layer from the printable layer after completion of the printing process. Further, a predefined number of parts in a desired shape are die cut through the printable layer up until the carrier layer.

12 Claims, 17 Drawing Sheets

PRINTABLE FILM LAYER WITH CARRIER LAYER AND METHOD OF USE

CROSS-REFERENCES TO RELATED APPLICATIONS

The present application is a continuation-in-part of a U.S. Non-Provisional patent application Ser. No. 16/008,741, filed Jun. 14, 2018, claiming priority under 35 U.S.C. § 119(e) to U.S. Provisional Patent Application No. 62/520,955, filed Jun. 16, 2017, the entire contents of which are incorporated by reference as if set forth fully herein.

TECHNICAL FIELD

The present disclosure relates generally to the field of printing, and more specifically to printing photographs on a printable film layer which is removably associated with a carrier layer.

BACKGROUND

Printing photos on a printing template is not a new technique of creating attractive photographs. The prior art provides several methods of ways of printing on the printing template using latex or UV printers/inks. The prior art also discloses the use of sublimation inks, which are used to initially print on a transfer material, then using a heat press, sublimate or transfer the image from the transfer material onto a piece of printing template that has been coated to receive these sublimation/heat transfer inks. There is also prior art on creating the printing templates for printing on them, where the printing template has to be covered with some sort of clear plastic coating to seal in the ink.

While these methods are effective in transferring an image onto a printing template, many aqueous inkjet printers "read" the edges of the printing template and print up to the edge—rather than over the edge —leaving an undesired "margin" around the edge of the printing template. These printers do not offer the "edge to edge" printing capabilities that result in top quality, attractive finished products. This is particularly true when printing on rigid substrates, but even when printing on non-rigid substrates, these printers do not produce truly "edge to edge" finished products. The requirement that the picture be covered with a plastic sheet to seal in the ink is also cumbersome and requires a person to make sure there are no bubbles under the plastic covering. Thus, there is a long-felt need for a product that can produce a borderless picture without the need for additional covering, and a method by which it can be made. This class of printer is often found at retail locations that will print pictures for the customer on demand.

SUMMARY

The current disclosure provides a solution to this problem by describing a combination of a printable coating on a printable layer and a carrier layer that are connected to each other such that an inkjet printer prints beyond the edge of the printable layer, rather than up to the edge of the printable layer as is the current state-of-the-art. Another key inventive step to this invention is the ability to print directly onto a printable layer without the need to place any layer of material over the finished product. The carrier layer also has a square or rectangular shape that has been pre-cut into the carrier layer so that it can be easily removed, for example, from the printable layer after the printing is completed.

The printing template and related method described herein achieves the stated goals by basically tricking certain aqueous inkjet printers to think that the desired "edge" of the print (e.g. photograph) to be transferred to the printable surface of the printable layer is outside the perimeter of the printable surface receiving the print, so that there is no "margin" or "border" left between the edge of the print and the edge of a printable surface after the printing is completed. The printable surface of the printable layer in the current invention has a special "coating" that accepts the aqueous inks that are common in these printers, as described above, so there is no need to add any plastic sealer or covering after the print leaves the printer. The printable layer is not printed on as a single unit, but rather comes on a "carrier layer" that is having same dimensions as that of the printing layer. The printable layer also utilizes a printable coating so that the ink does not run. By way of example, this printable coating may be a film such as PET, BOPP, Polypropylene, or Polycarbonate that has been coated with a microporous aqueous inkjet-adhering layer. The coating technique can be accomplished with slot die, curtain, gravure, or Mayer rod techniques (for example).

As previously mentioned, the aqueous inkjet printers will not print edge to edge on the printable surface of the printable layer to receive the print, a carrier layer is used in the printing process. The carrier layer is equal to the printable layer; however, a printable surface defined on the printable layer is smaller than the printable layer and thus allows the printer to print completely across all the edges of the printable surface to create a borderless photograph on the printable surface of the printable layer. For example, if one were to print on an 11"×14" printable surface using the prior art methods, a resulting picture would have a border of unprinted metal showing the deficiencies of that method. However, by associating the 11"×14" printable surface with a 16"×20" printable layer, the printer can print the 11"×14" printable surface without a border. To "trick" the printer into printing beyond the edges of the 11"×14" printable surface, the printable surface is defined within shaped parameters of the printable layer. This "tricks" printer sensors that detect the end of the printable layer for example by detecting a change in surface reflectivity as the printer encounters the edge of the printable layer.

Thus, the problem of how to create borderless metal prints is solved by providing a printable layer upon which the printable surface is defined. The carrier layer has an adhesive coating that holds the printable layer on top of the carrier layer during transport and printing processes.

It is a principal object of the disclosure to provide a means by which a printable layer can have a picture printed on its printable surface by a standard industry inkjet printer using standard industry ink, without a border or margin.

A further object of the disclosure is to provide a number of different products by die cutting a predefined number of parts in a desired shape through the printable layer until the carrier layer.

A further object of the disclosure is to provide the printable layer with a core layer having bottom side removably associated with the carrier layer. By changing the die cut shape, the thickness of the core layer, the shape of the printable surface, a printed product can be used to make disposable bar coasters, puzzles, board prints where the image is printed to the edge of the board, playing cards, sports trading cards, greeting cards, and so forth.

Another object of the disclosure is to provide a silicon release liner attached to the bottom side of the printable layer to prevent the carrier layer from bonding permanently or at least too securely to the bottom of the predefined number of parts.

It is another object of the disclosure to provide at least two portions on the printable surface of the printable film. Each of the at least two portions includes a predefined number of parts which are die cut in same or different shapes and sizes.

There has thus been outlined, rather broadly, the more important features of the metal photographic plate and carrier in order that the detailed description thereof may be better understood, and in order that the present contribution to the art may be better appreciated. There are additional features that will be described hereinafter and which will form the subject matter of the claims appended hereto. The features listed herein and other features, aspects and advantages of the present disclosure will become better understood with reference to the following description and appended claims.

BRIEF DESCRIPTION OF THE DRAWINGS

Many advantages of the present disclosure will be apparent to those skilled in the art with a reading of this specification in conjunction with the attached drawings, wherein like reference numerals are applied to like elements and wherein.

DETAILED DESCRIPTION OF A PREFERRED EMBODIMENT

Figure 1:
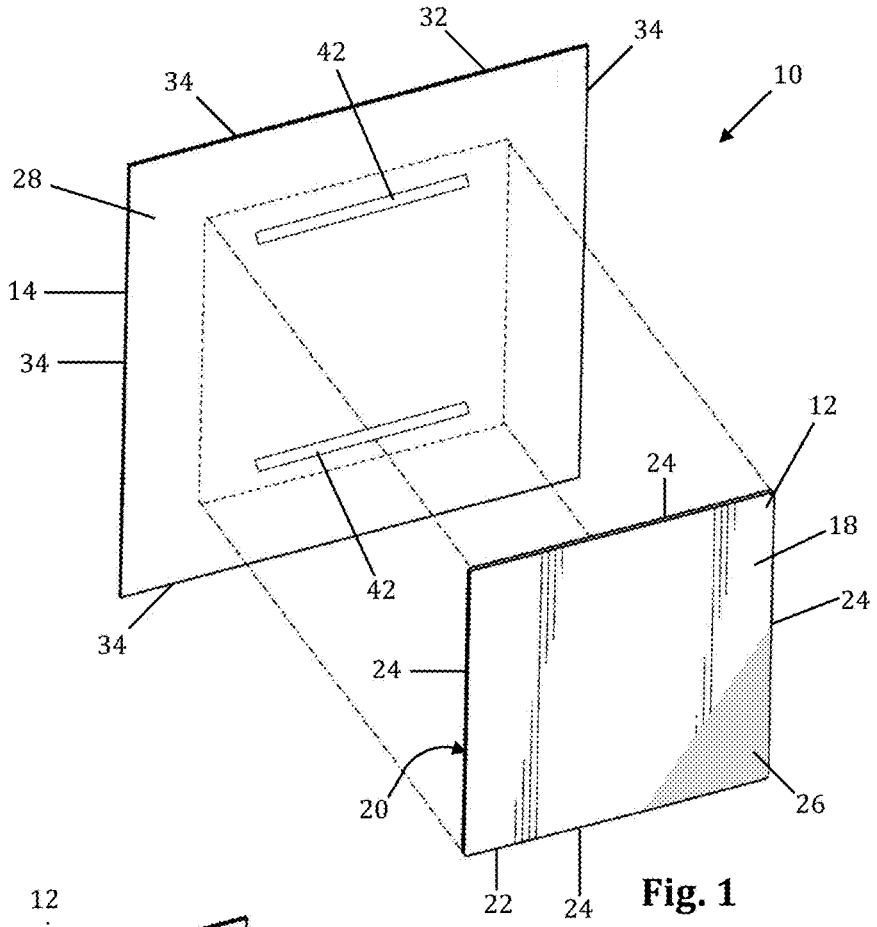
FIG. 1 is a perspective view of an example of a printable metal plate in alignment for association with an example of a metal plate carrier, according to one embodiment of the disclosure.

Illustrative embodiments of the disclosure are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. The metal photographic plate with carrier and related methods disclosed herein boasts a variety of inventive features and components that warrant patent protection, both individually and in combination.

FIGS. 1-5 illustrate a first example of a printing template 10 for use in aqueous inkjet printing onto a metal substrate, according to one embodiment of the disclosure. By way of example only, the printing template 10 of the instant embodiment includes a printable metal plate 12, a carrier 14, and a hanging element 16. The printable metal plate 12 has front face 18, a back face 20, and a perimeter 22. In the example shown in FIGS. 1-5, the printable metal plate 12 has a generally rectangular shape having four opposing edges 24, however it should be understood that the metal plate 12 may have any shape (e.g. circular, oval, triangular, etc.) without departing from the scope of the disclosure. Preferably, the metal plate 12 is made of aluminum, however other any other suitable metal may be used.

The front face 18 is completely covered by a printable film layer 26, and defines the printable surface of the metal plate 12. The printable film layer 26 may be any material that is capable of accepting aqueous inkjet ink, including but not limited to (and by way of example only) polyester, polyethylene, Mylar, vinyl, PVC, PET, BOTT, polypropylene, polycorbonate, and acrylics. The key to the selection of the film is that it can accept and retain the aqueous ink from an inkjet printer. According to a preferred embodiment, an inkjet ink-retaining microporous coating may be applied on top of the printable film layer 26 to enhance the ink retention properties of the printable film layer 26. The coating technique can be accomplished (by way of example) with slot die, curtain, gravure or Mayer rod techniques. It should be noted, however, that the key characteristics of the printable film layer 26 include, but are not limited to, ink adhesion and retention properties, cost, and optical clarity. With the use of this specialized printable film 26, there is no need for any "final" covering sheet or other process to seal in the ink after the metal print leaves the printer.

The carrier 14 has front face 28, a back face 30, and a perimeter 32. The carrier 14 is sized and configured such that carrier 14 is larger than the metal plate 12, and more specifically such that the entire perimeter 32 of the carrier 14 is outside of the entire perimeter 22 of the metal plate 12 when the metal plate 12 is associated with the carrier 14. The respective perimeter shapes of the metal plate 12 and carrier 14 do not have to match. In the example shown in FIGS. 1-5, the carrier 14 has a generally rectangular shape having four opposing edges 34. Although the generally rectangular shape is preferable since the carrier 14 interacts with the printer and therefore consistency of size and shape is advantageous, nevertheless it should be understood that the carrier 14 may have any perimeter shape (e.g. circular, oval, triangular, etc.) without departing from the scope of the disclosure, so long as the entire perimeter 32 of the carrier is 14 is outside of the entire perimeter 22 of the metal plate 12. That is because a portion of the front face 28 (e.g. the portion of the front face 28 that is immediately adjacent the perimeter 22 of the metal plate 12) represents a "print zone" 36 that receives ink from the ink dispensing element of the printer when the ink dispensing element traverses beyond the perimeter 22 of the metal plate 12 during the printing process.

Figure 4:
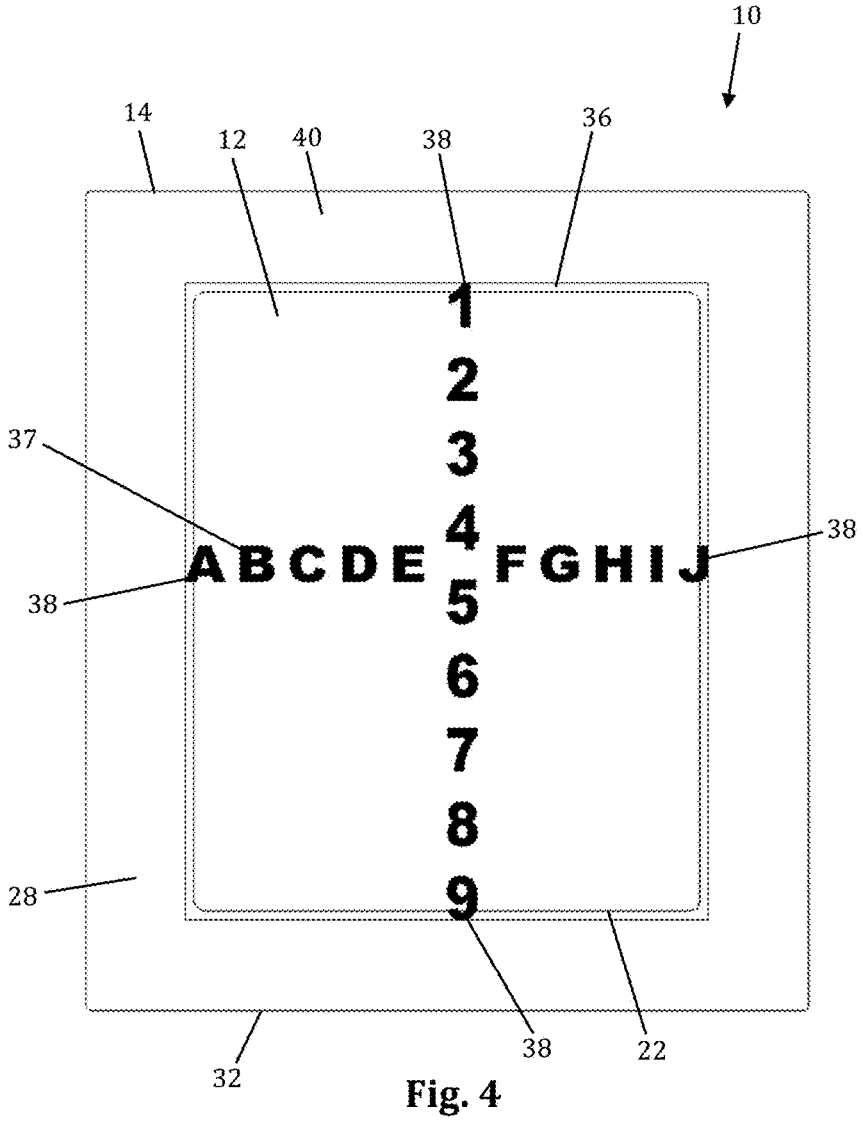
FIG. 4 is a plan view of the metal plate and carrier of FIG. 3 after printing has occurred.
Figure 5:
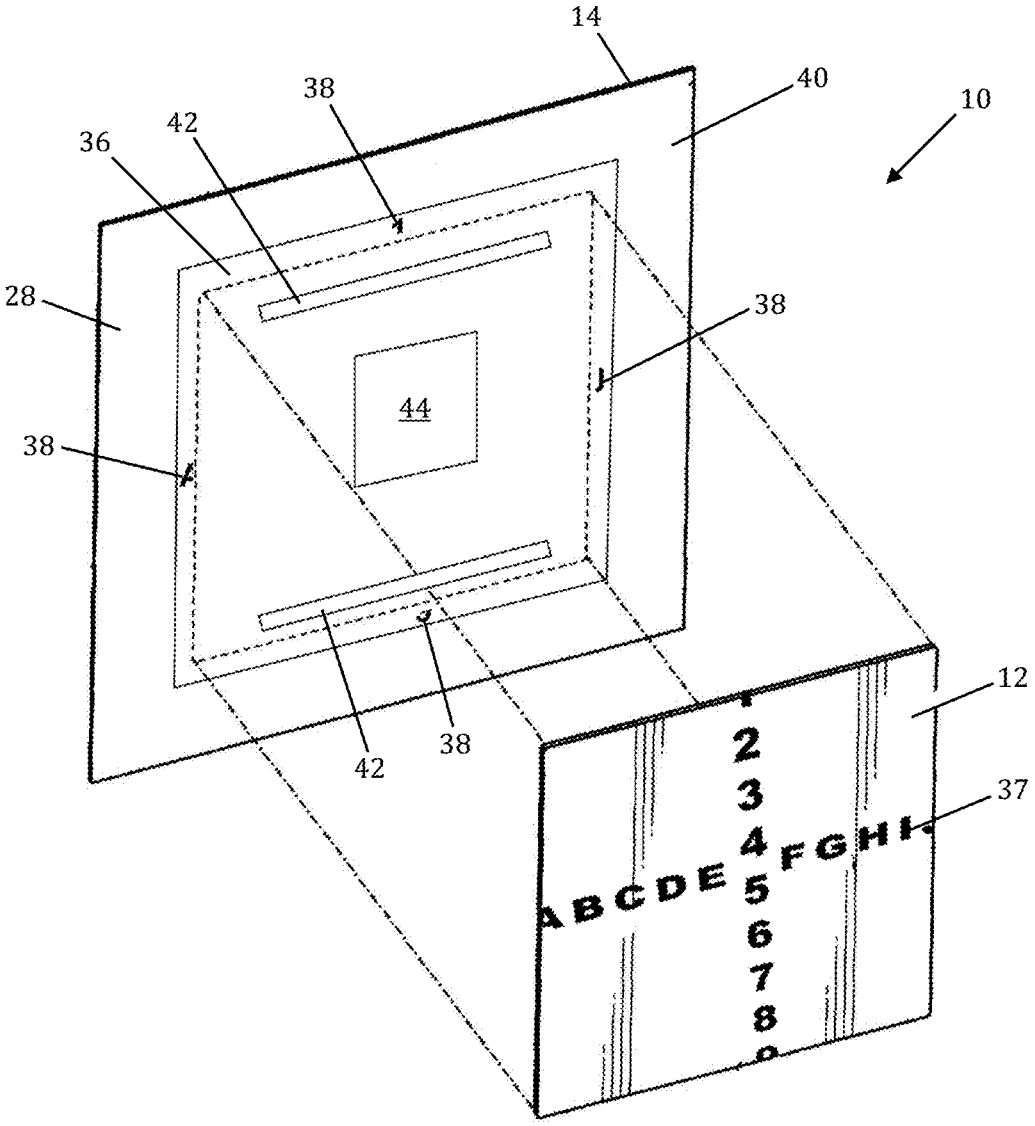
FIG. 5 is a perspective view of the post-printing metal plate and carrier of FIG. 4, particularly illustrating the metal plate being removed from the carrier and showing how the printer is "tricked" by the carrier into printing over the edges of the metal plate onto a portion of the carrier, thereby avoiding an unprinted margin or border on the metal plate.

The front face 28 of the carrier 14 has an external coat that mimics the printable film layer 26 of the metal plate 12 such that the printer prints over the edges 24 of the metal plate 12 onto the carrier 14. This results in the metal plate 12 having printing 37 over its entire front face 18, and then leaving a narrow strip of overlap printing 38 in the print zone 36 of the carrier 14 that surrounds the edges 24 of the metal plate 12, while leaving an unprinted section 40 of the carrier 14 that was not printed upon, as shown in FIGS. 4-5.

Figure 3:
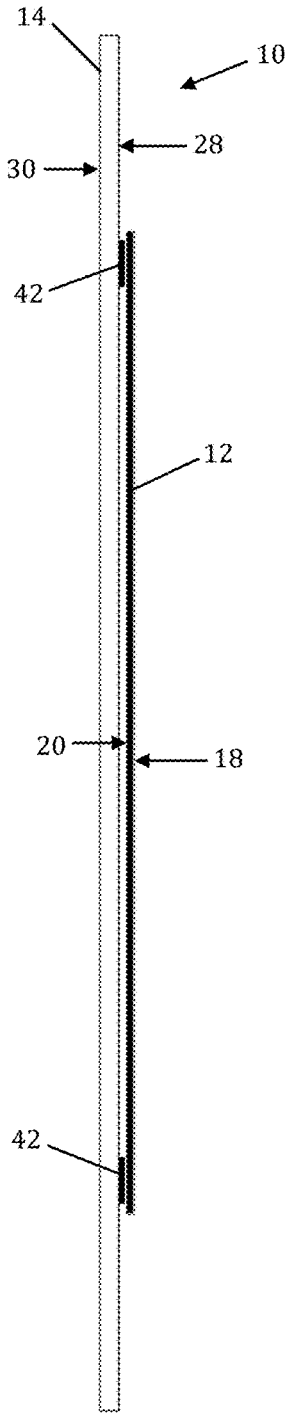
FIG. 3 is a side plan view of the printable metal plate of FIG. 1 associated with the carrier of FIG. 1.

The carrier 14 further includes at least one metal plate engaging element 42 configured to engage the metal plate 12 and maintain the association of the metal plate 12 and carrier 14 through the printing process. By way of example, the plate engaging element 42 of the instant embodiment comprises adhesive strips that secure the metal plate 12 to the front surface 28 of the carrier 14 during the printing process, as shown in FIGS. 1 and 3. The adhesive strips 42 allow for removal of the metal plate 12 from the carrier 14 by exerting sufficient force on the metal plate 12 to overpower the adhesive strip.

The back face 30 of the carrier 14 includes at least one perforated section that is removable to create a cutout opening 44 through which the hanging element 16 may be attached to the back face 20 of the metal plate 12 prior to disassociating the metal plate 12 and carrier 14. By way of example, the cutout opening 44 is shown as having a generally rectangular (or square) shape, however any shape is possible that allows passage of the hanging element 16 therethrough. The back face 20 of the metal plate 12 includes a leveling indicia 46 that serves as an alignment guide for placing the hanging element 16 on the back of the metal plate 12 as the hanging element 16 is inserted into the cutout opening 44 of the carrier 14.

Figure 2:
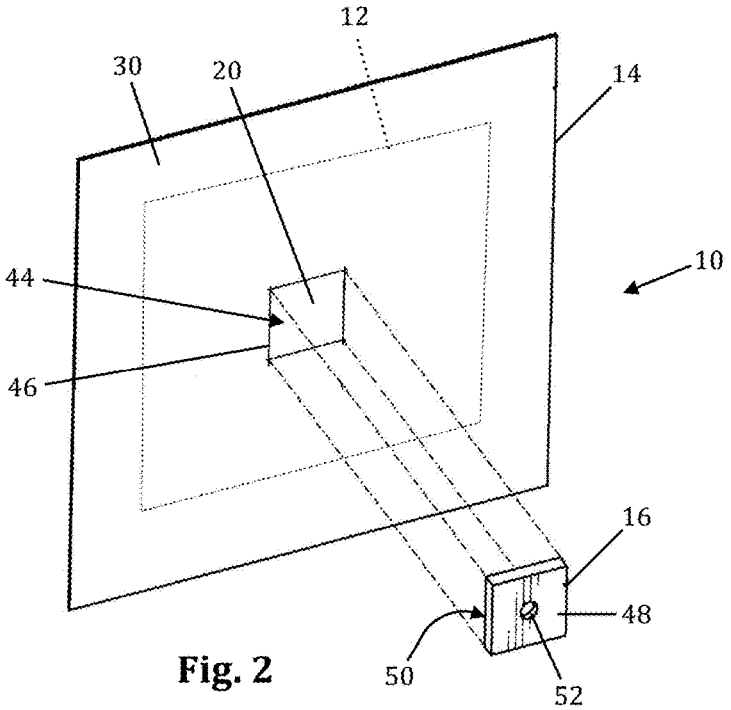
FIG. 2 is a perspective view of the back of the carrier of FIG. 1 with an example of a hanging element in alignment with a leveling indicia on the back of the carrier enabling a user to attach the hanging element to the back of the metal plate of FIG. 1 through a hole in the carrier.

The hanging element 16 of the present disclosure may be any attachable element or object that enables a user to hang the metal plate 12 on a wall. By way of example only, the hanging element 16 shown in FIG. 2 is a generally rectangular (or square) piece of material (e.g. metal) having a front side 48 and a back side 50. The back side 50 includes an adhesive layer (not shown) that enables the hanging element 16 to be attached to the back face 20 of the metal plate 12 through the cutout opening 44 in the carrier 14. The hanging element 16 further includes a through-hole 52 (for example) sized and configured to receive at least a portion of a wall-mounted hanging element (not shown) so that the printed metal plate 12 may be displayed on a wall (see e.g. FIG. 18).

FIGS. 6-11 illustrate a second example of a printing template 110 for use in aqueous inkjet printing onto a metal substrate, according to one embodiment of the disclosure. By way of example only, the printing template 110 of the instant embodiment includes a printable metal plate 112, a carrier 114, and a hanging element (not shown). The printable metal plate 112 has front face 118, a back face 120, and a perimeter 122. In the example shown in FIGS. 6-11, the printable metal plate 112 has a generally rectangular shape having four opposing edges 124, however it should be understood that the metal plate 112 may have any shape (e.g. circular, oval, triangular, etc.) without departing from the scope of the disclosure. Preferably, the metal plate 112 is made of aluminum, however other any other suitable metal may be used.

The front face 118 is completely covered by a printable film layer 126, and defines the printable surface of the metal plate 112. The printable film layer 126 may be any material that is capable of accepting aqueous inkjet ink, including but not limited to (and by way of example only) polyester, polyethylene, Mylar, vinyl, PVC, PET, BOTT, polypropylene, polycorbonate, and acrylics. The key to the selection of the film is that it can accept and retain the aqueous ink from an inkjet printer. According to a preferred embodiment, an inkjet ink-retaining microporous coating may be applied on top of the printable film layer 126 to enhance the ink retention properties of the printable film layer 126. The coating technique can be accomplished (by way of example) with slot die, curtain, gravure or Mayer rod techniques. It should be noted, however, that the key characteristics of the printable film layer 126 include, but are not limited to, ink adhesion and retention properties, cost, and optical clarity. With the use of this specialized printable film 126, there is no need for any "final" covering sheet or other process to seal in the ink after the metal print leaves the printer.

The carrier 114 has front face 128, a back face 130, and a perimeter 132. The carrier 114 is sized and configured such that carrier 114 is larger than the metal plate 112, and more specifically such that the entire perimeter 132 of the carrier 114 is outside of the entire perimeter 122 of the metal plate 112 when the metal plate 112 is associated with the carrier 114. The respective perimeter shapes of the metal plate 112 and carrier 114 do not have to match. In the example shown in FIGS. 6-11, the carrier 114 has a generally rectangular shape having four opposing edges 134. Although the generally rectangular shape is preferable since the carrier 114 interacts with the printer and therefore consistency of size and shape is advantageous, nevertheless it should be understood that the carrier 114 may have any perimeter shape (e.g. circular, oval, triangular, etc.) without departing from the scope of the disclosure, so long as the entire perimeter 132 of the carrier is 114 is outside of the entire perimeter 122 of the metal plate 112. That is because a portion of the front face 128 (e.g. the portion of the front face 128 that is immediately adjacent the perimeter 122 of the metal plate 112) represents a "print zone" 136 that receives ink from the ink dispensing element of the printer when the ink dispensing element traverses beyond the perimeter 122 of the metal plate 112 during the printing process.

Figure 10:
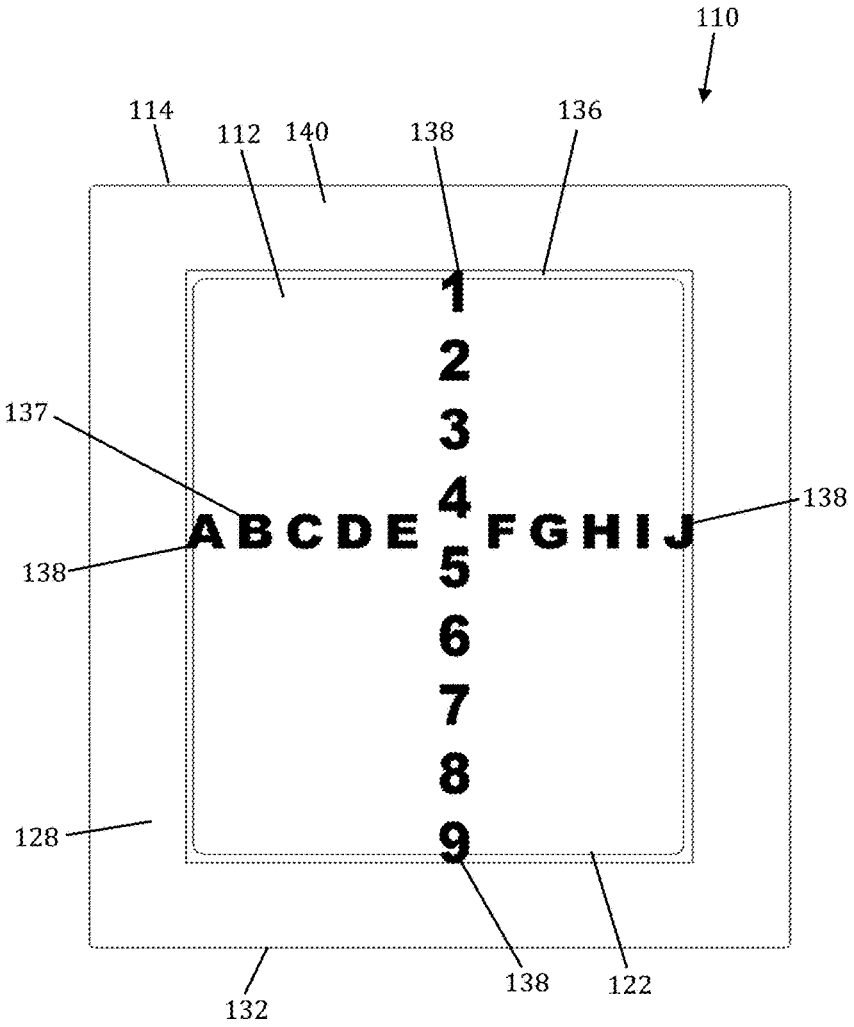
FIG. 10 is a plan view of the metal plate and carrier of FIG. 9 after printing has occurred.
Figure 11:
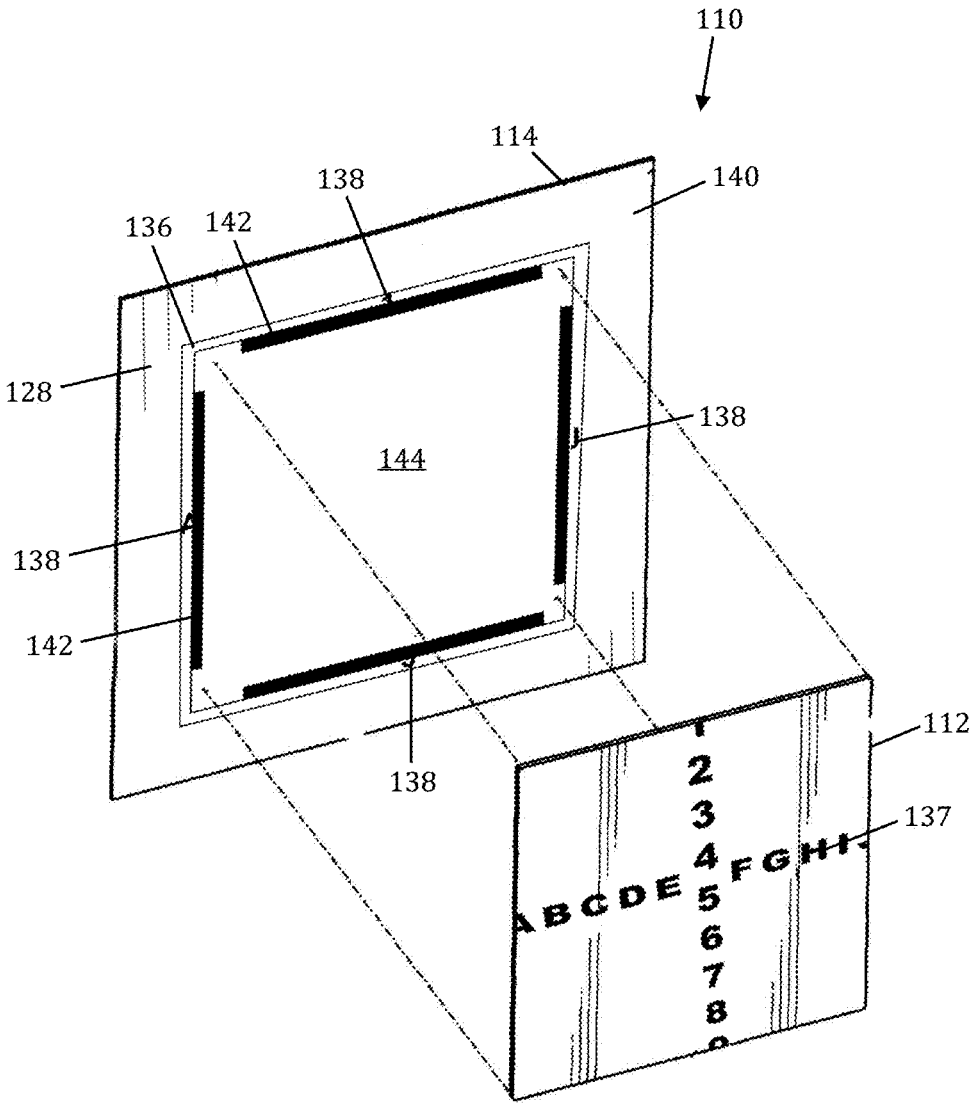
FIG. 11 is a perspective view of the post-printing metal plate and carrier of FIG. 10, particularly illustrating the metal plate being removed from the carrier and showing how the printer is "tricked" by the carrier into printing over the edges of the metal plate onto a portion of the carrier, thereby avoiding an unprinted margin or border on the metal plate.
Figure 12:
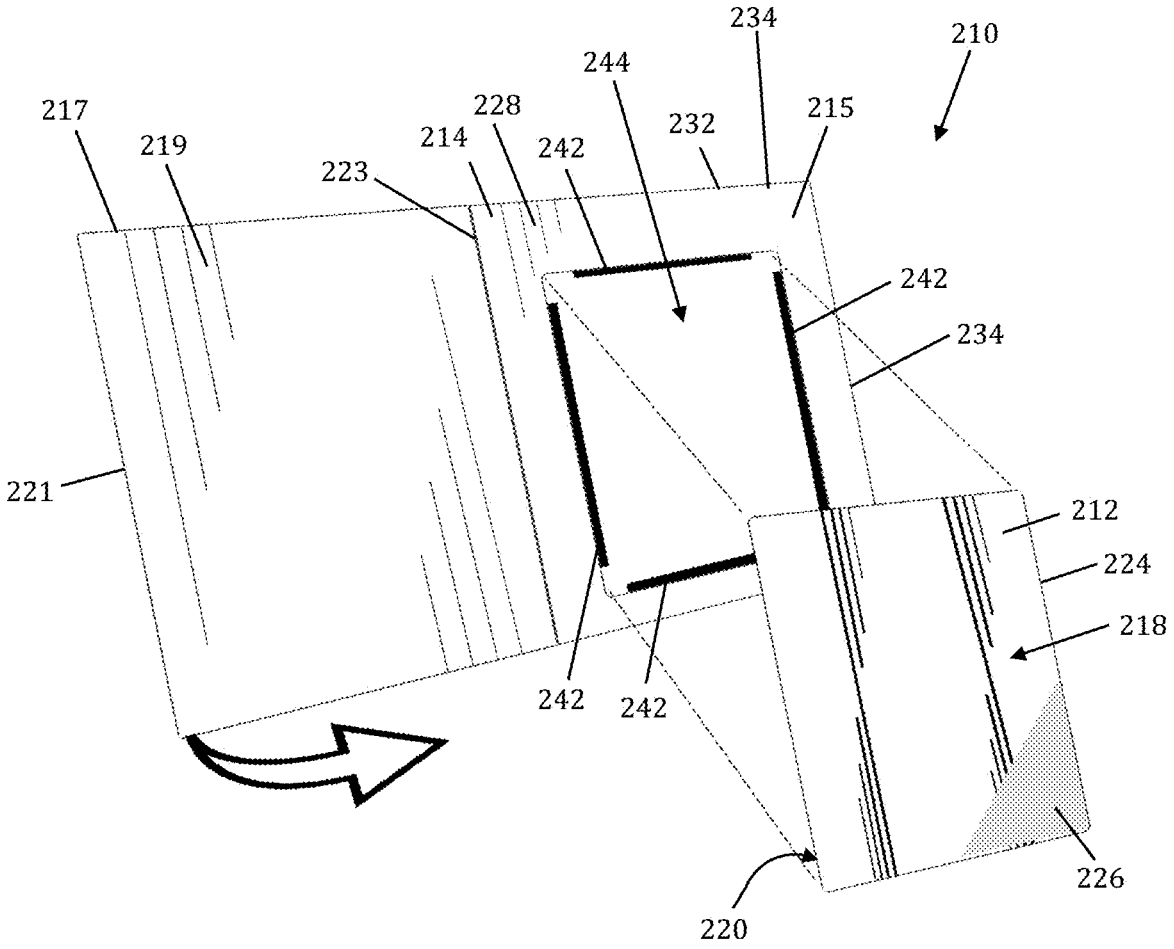
FIG. 12 is a perspective view of an example of a printable metal plate in alignment for association with an example of a metal plate carrier, according to another embodiment of the disclosure.

The front face 128 of the carrier 114 has an external coat that mimics the printable film layer 126 of the metal plate 112 such that the printer prints over the edges 124 of the metal plate 112 onto the carrier 114. This results in the metal plate 112 having printing 137 over its entire front face 118, and then leaving a narrow strip of overlap printing 138 in the print zone 136 of the carrier 114 that surrounds the edges 124 of the metal plate 112, while leaving an unprinted section 140 of the carrier 114 that was not printed upon, as shown in FIGS. 10-11.

Figure 6:
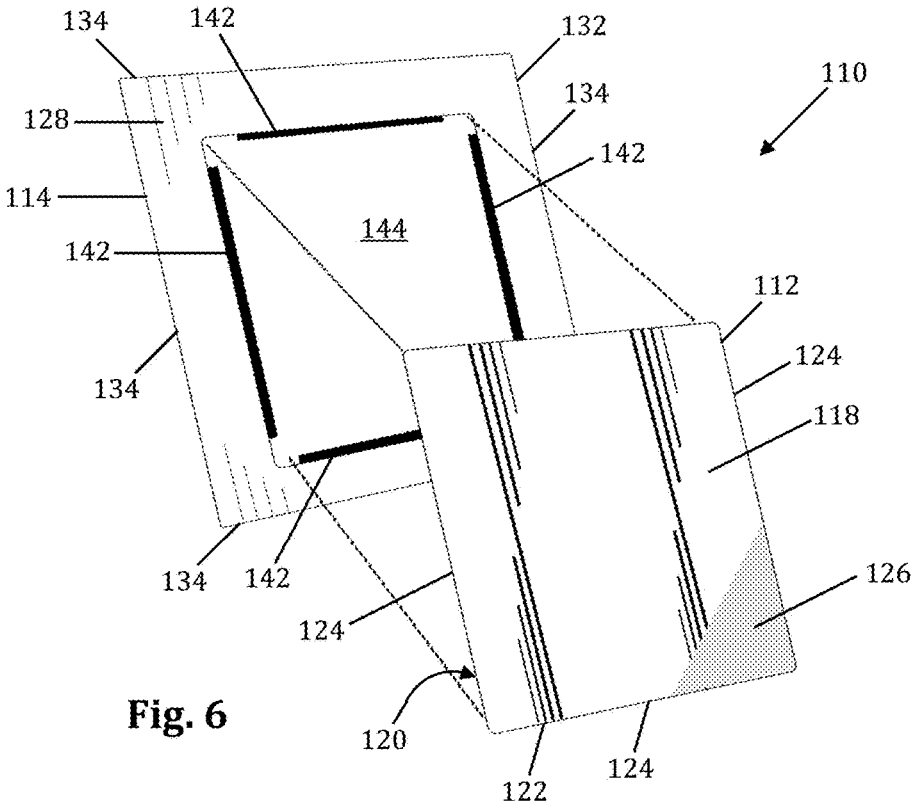
FIG. 6 is a perspective view of an example of a printable metal plate in alignment for association with an example of a metal plate carrier, according to another embodiment of the disclosure.
Figure 7:
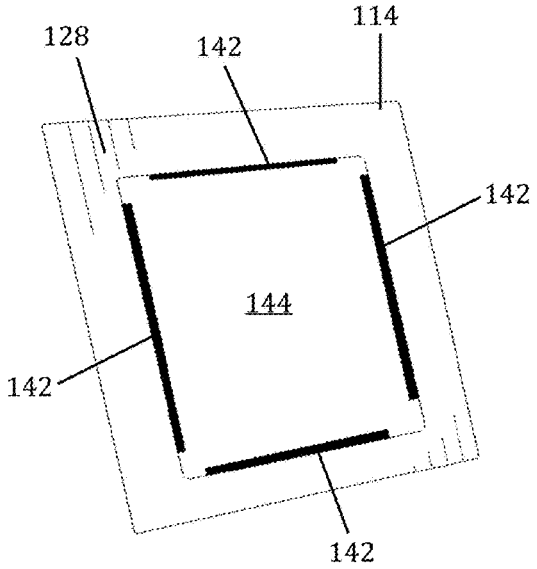
FIG. 7 is a perspective view of a front side of the carrier of FIG. 6.
Figure 8:
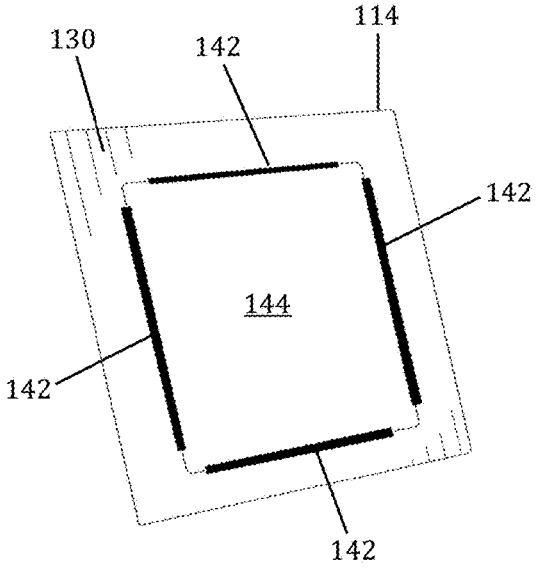
FIG. 8 is a perspective view of a back side of the carrier of FIG. 6.
Figure 9:
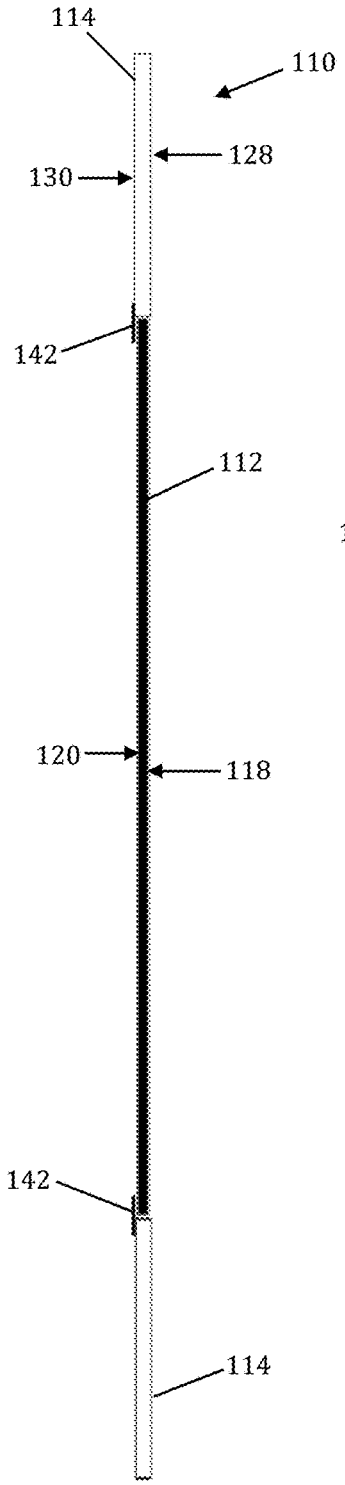
FIG. 9 is a side plan view of the printable metal plate of FIG. 6 associated with the carrier of FIG. 6.

The carrier 114 further includes at least one metal plate engaging element 142 configured to engage the metal plate 112 and maintain the association of the metal plate 112 and carrier 114 through the printing process. By way of example, the plate engaging element 142 of the instant embodiment comprises adhesive strips 142 that secure the metal plate 112 within a cutout opening 144 formed through the carrier 114 during the printing process, as shown in FIGS. 6 and 9. The adhesive strips 142 allow for removal of the metal plate 112 from the carrier 114 by exerting sufficient force on the metal plate 112 to overpower the adhesive strip. As shown in FIGS. 7-8, preferably the adhesive strips 142 are positioned such that a first portion of each adhesive strip is attached to the back face 130 of the carrier 114, and a second portion of each adhesive strip extends into the cutout opening 144 to enable engagement with the metal plate 112.

The cutout opening 144 is sized and configured to receive the entire perimeter 122 of the metal plate 112 thereby creating a recessed association between the metal plate 112 and carrier 114. By way of example, the cutout opening 144 is shown as having a generally rectangular (or square) perimeter shape, however any shape is possible that receives and securely engages the metal plate 112 during printing. In order to be able to receive the metal plate 112 therein, the perimeter of the cutout opening 144 must be larger than the perimeter 122 of the metal plate 112. Preferably, the distance between any part of the perimeter 122 of the metal plate 112 and the perimeter edge of the cutout opening 144 is within the range of 0.005-0.015". Gaps larger than 0.015" may cause the printer to detect the edge of the metal plate 112 and stop printing. Gaps smaller than 0.005" may cause the metal plate 112 to not fit within the cutout opening 144, especially in warm and/or humid climates.

The recessed association between the metal plate 112 and carrier 114 is advantageous in that it decreases the overall thickness of the plate/carrier combination, which in turn reduces the risk of metal plate 112 making contact with any of the internal components of the printer. Since most of the commercially available wide format aqueous inkjet printers that are compatible with the printing template 110 disclosed herein have a maximum allowable material thickness of approximately 1.5 mm, a recessed association between the plate 112 and carrier 114 enables a decrease in overall thickness of the printing template 110 and/or and increase in the thickness of the metal plate 112 to be printed on.

The hanging element (not shown) of the present embodiment is identical to the hanging element 16 described above, and may be attached to the back face 120 of the metal plate 112 through the cutout opening 144.

FIGS. 12-17 illustrate a third example of a printing template 210 for use in aqueous inkjet printing onto a metal substrate, according to one embodiment of the disclosure. By way of example only, the printing template 210 of the instant embodiment includes a printable metal plate 212, a carrier 214, and a hanging element (not shown). The printable metal plate 212 has front face 218, a back face 220, and a perimeter 222. In the example shown in FIGS. 12-17, the printable metal plate 212 has a generally rectangular shape having four opposing edges 224, however it should be understood that the metal plate 212 may have any shape (e.g. circular, oval, triangular, etc.) without departing from the scope of the disclosure. Preferably, the metal plate 212 is made of aluminum, however other any other suitable metal may be used.

The front face 218 is completely covered by a printable film layer 226, and defines the printable surface of the metal plate 212. The printable film layer 226 may be any material that is capable of accepting aqueous inkjet ink, including but not limited to (and by way of example only) polyester, polyethylene, Mylar, vinyl, PVC, PET, BOTT, polypropylene, polycorbonate, and acrylics. The key to the selection of the film is that it can accept and retain the aqueous ink from an inkjet printer. According to a preferred embodiment, an inkjet ink-retaining microporous coating may be applied on top of the printable film layer 226 to enhance the ink retention properties of the printable film layer 226. The coating technique can be accomplished (by way of example) with slot die, curtain, gravure or Mayer rod techniques. It should be noted, however, that the key characteristics of the printable film layer 226 include, but are not limited to, ink adhesion and retention properties, cost, and optical clarity. With the use of this specialized printable film 226, there is no need for any "final" covering sheet or other process to seal in the ink after the metal print leaves the printer.

The carrier 214 comprises a plate-holding portion 215 and a plate-protecting element 217. By way of example, the plate-holding portion 215 is similar to the carrier 114 described above, and has front face 228, a back face 230, and a perimeter 232. The carrier 214 is sized and configured such that plate-holding portion 215 is larger than the metal plate 212, and more specifically such that the entire perimeter 232 of the plate-holding portion 215 is outside of the entire perimeter 222 of the metal plate 212 when the metal plate 212 is associated with the carrier 214. The respective perimeter shapes of the metal plate 212 and plate-holding portion 215 do not have to match. In the example shown in FIGS. 12-17, the plate-holding portion 215 has a generally rectangular shape having four opposing edges 234. Although the generally rectangular shape is preferable since the carrier 214 interacts with the printer and therefore consistency of size and shape is advantageous, nevertheless it should be understood that the plate-holding portion 215 may have any perimeter shape (e.g. circular, oval, triangular, etc.) without departing from the scope of the disclosure, so long as the entire perimeter 232 of the plate-holding portion 215 is outside of the entire perimeter 222 of the metal plate 212. That is because a portion of the front face 228 (e.g. the portion of the front face 228 that is immediately adjacent the perimeter 222 of the metal plate 212) represents a "print zone" 236 that receives ink from the ink dispensing element of the printer when the ink dispensing element traverses beyond the perimeter 222 of the metal plate 112 during the printing process (see e.g. FIG. 16).

Figure 16:
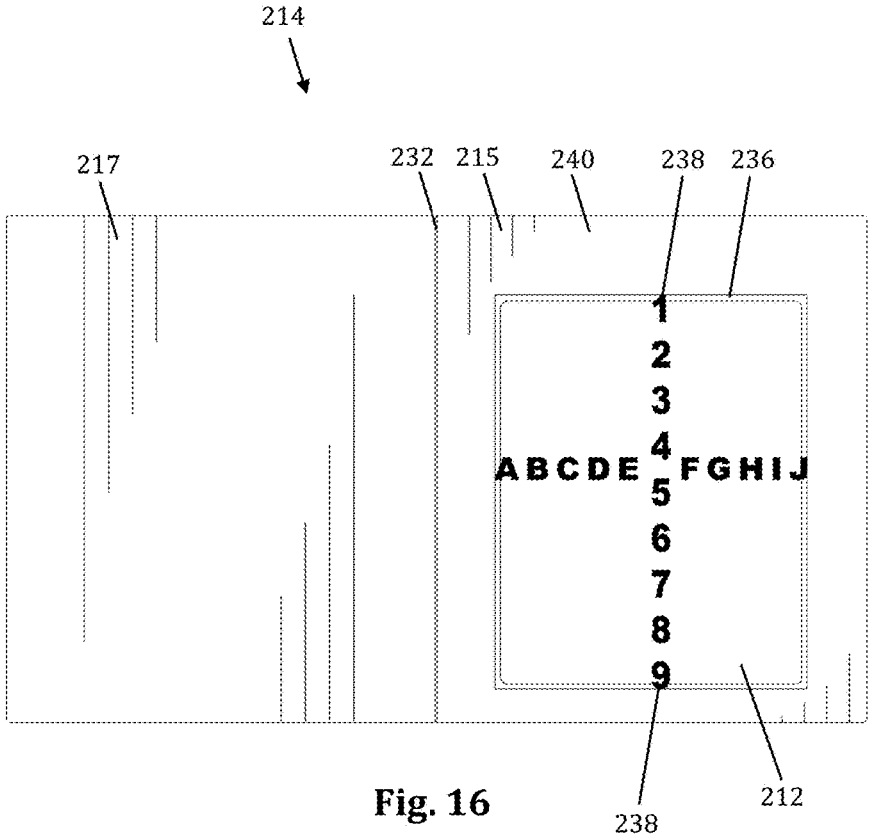
FIG. 16 is a plan view of the metal plate and carrier of FIG. 15 after printing has occurred.
Figure 17:
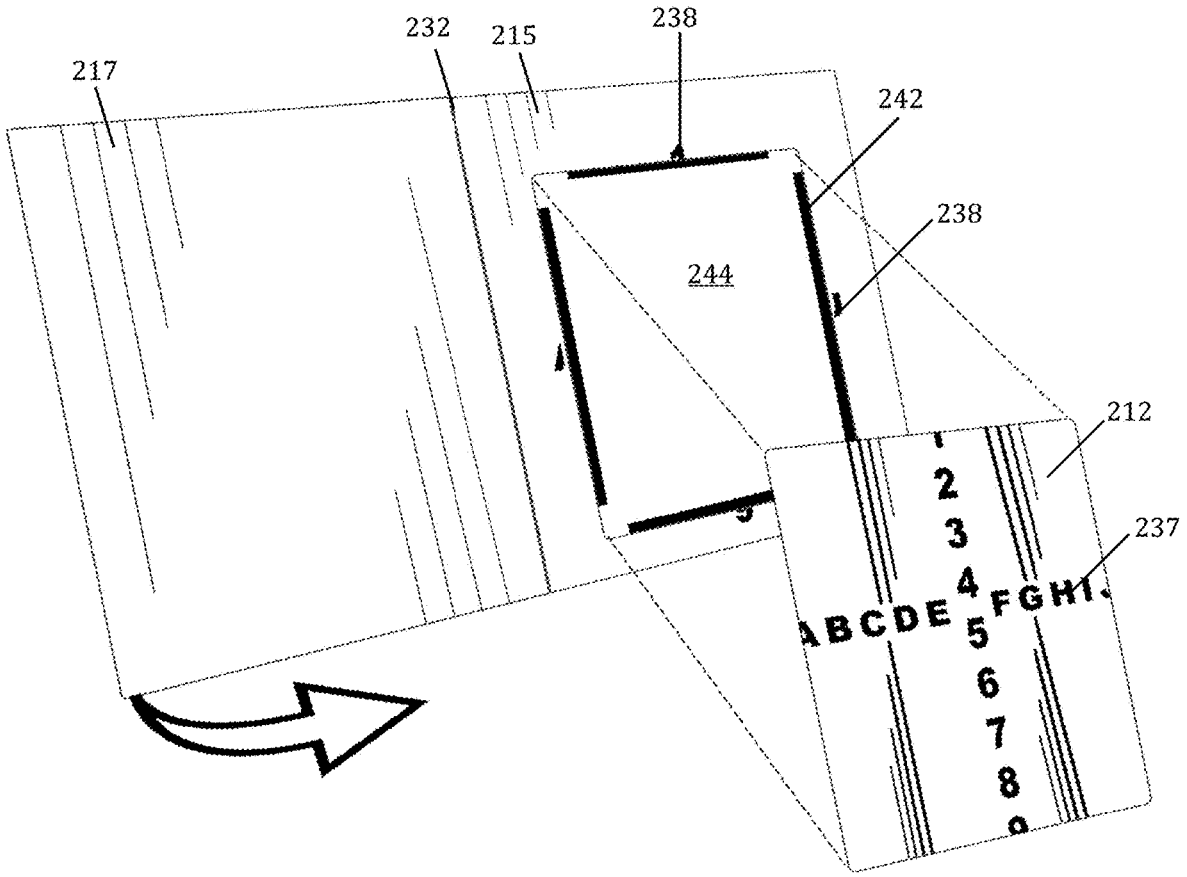
FIG. 17 is a perspective view of the post-printing metal plate and carrier of FIG. 16, particularly illustrating the metal plate being removed from the carrier and showing how the printer is "tricked" by the carrier into printing over the edges of the metal plate onto a portion of the carrier, thereby avoiding an unprinted margin or border on the metal plate.

The front face 228 of the plate-holding portion 215 has an external coat that mimics the printable film layer 226 of the metal plate 212 such that the printer prints over the edges 224 of the metal plate 212 onto the carrier 214. This results in the metal plate 212 having printing 237 over its entire front face 218, and then leaving a narrow strip of overlap printing 238 in the print zone 236 of the plate-holding portion 215 that surrounds the edges 224 of the metal plate 212, while leaving an unprinted section 240 of the carrier 214 that was not printed upon, as shown in FIGS. 16-17.

Figure 13:
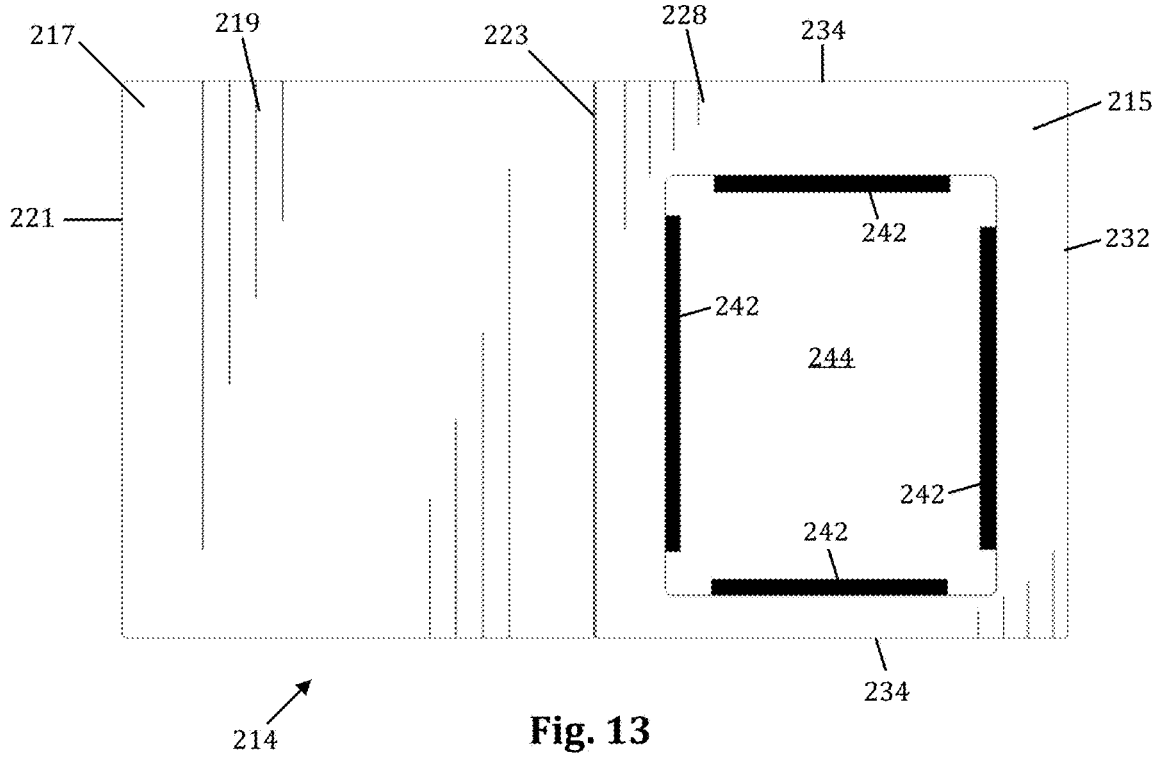
FIG. 13 is a perspective view of a front side of the carrier of FIG. 12.
Figure 14:
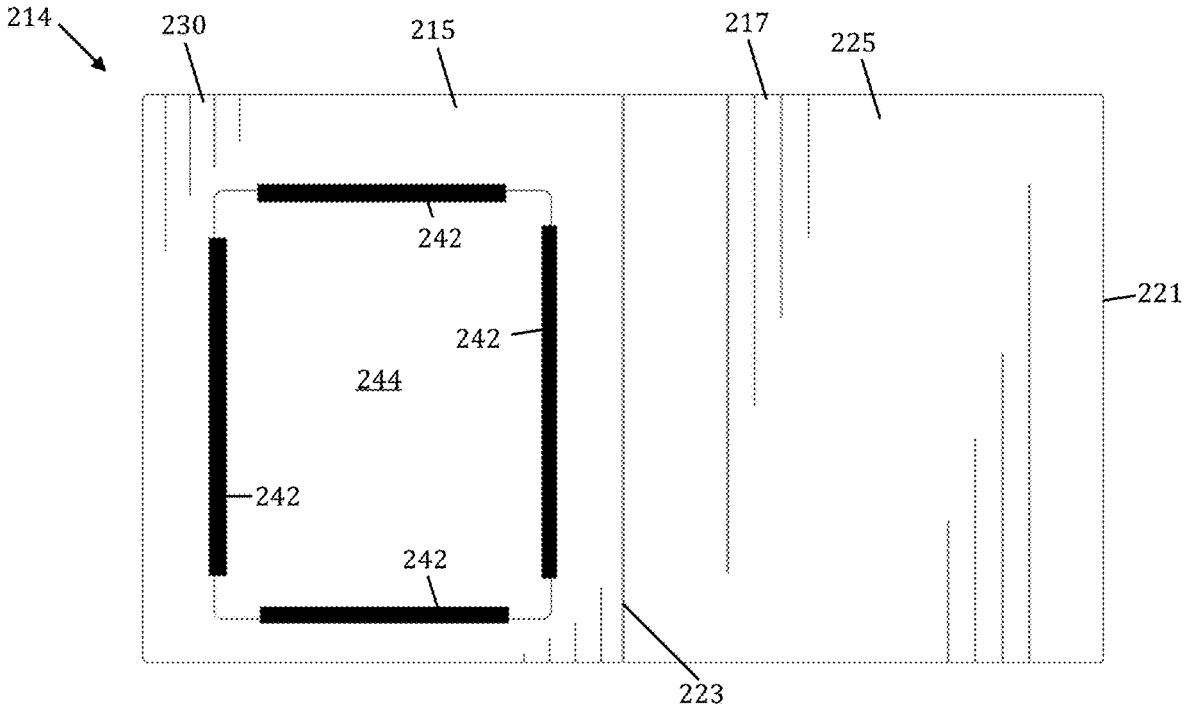
FIG. 14 is a perspective view of a back side of the carrier of FIG. 12.
Figure 15:
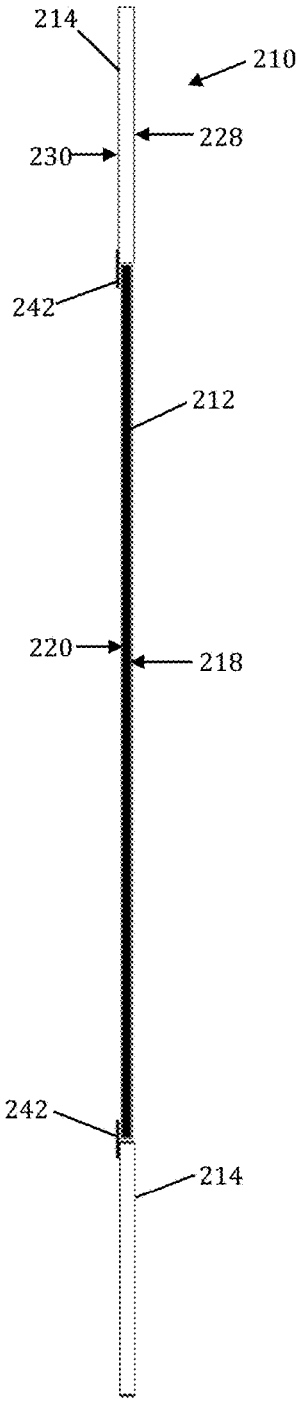
FIG. 15 is a side plan view of the printable metal plate of FIG. 12 associated with the carrier of FIG. 6.

The plate-holding portion 215 of the carrier 214 further includes at least one metal plate engaging element 242 configured to engage the metal plate 212 and maintain the association of the metal plate 212 and carrier 214 through the printing process. By way of example, the plate engaging element 242 of the instant embodiment comprises adhesive strips 242 that secure the metal plate 212 within a cutout opening 244 formed through the plate-holding portion 215 during the printing process, as shown in FIGS. 12-15. The adhesive strips 242 allow for removal of the metal plate 212 from the carrier 214 by exerting sufficient force on the metal plate 212 to overpower the adhesive strips. As shown in FIGS. 13-14, preferably the adhesive strips 242 are positioned such that a first portion of each adhesive strip is attached to the back face 230 of the plate-holding portion 215, and a second portion of each adhesive strip extends into the cutout opening 244 to enable engagement with the metal plate 212.

The cutout opening 244 is sized and configured to receive the entire perimeter 222 of the metal plate 212 thereby creating a recessed association between the metal plate 212 and carrier 214. By way of example, the cutout opening 244 is shown as having a generally rectangular (or square) perimeter shape, however any shape is possible that receives and securely engages the metal plate 212 during printing. In order to be able to receive the metal plate 212 therein, the perimeter of the cutout opening 244 must be larger than the perimeter 222 of the metal plate 212. Preferably, the distance between any part of the perimeter 222 of the metal plate 212 and the perimeter edge of the cutout opening 244 is within the range of 0.005-0.015". Gaps larger than 0.015" may cause the printer to detect the edge of the metal plate 212 and stop printing. Gaps smaller than 0.005" may cause the metal plate 212 to not fit within the cutout opening 244, especially in warm and/or humid climates.

The recessed association between the metal plate 212 and carrier 214 is advantageous in that it decreases the overall thickness of the plate/carrier combination, which in turn reduces the risk of metal plate 212 making contact with any of the internal components of the printer. Since most of the commercially available wide format aqueous inkjet printers that are compatible with the printing template 210 disclosed herein have a maximum allowable material thickness of approximately 1.5 mm, a recessed association between the plate 212 and carrier 214 enables a decrease in overall thickness of the printing template 210 and/or and increase in the thickness of the metal plate 212 to be printed on.

The plate-protecting portion 217 may be any feature or element that protects the printable surface 218 (including the printable film 226) of the metal plate 212 before and/or after the printing process has been completed. By way of example only, the plate-protecting portion 217 of the present embodiment comprises a foldable flange 217 extending from one edge 234 of the plate-holding portion 215. The flange 217 includes a front face 219, a back face 225, and a perimeter edge 221. Because the flange 217 does not receive any ink during the printing process, the front face 219 does not need to be coated with the same external coat (mimicking the printable film layer 226) used on the plate-holding portion 215. The perimeter edge 221 is sized and configured such that the plate-protecting portion 217 is large enough to cover the metal plate 212 within the cutout opening 244, and preferably is the same size and shape as the perimeter 232 of the plate-holding portion 215. The plate-protecting portion 217 is joined to the plate-holding portion at an interface 223, that allows the plate-protecting portion 217 to fold (or pivot) over the plate-holding portion 215 such that the front face 219 of the plate-protecting portion 217 contacts the front face 218 of the plate-holding portion 215. By way of example, the interface 223 may be any feature or element that enables this folding, including but not limited to a hinge, groove, adhesive, etc.). In any event, the plate-protecting portion 217 is in an "open" or "unfolded" configuration during the printing process, in which the plate-protecting portion 217 is located to the side of and is generally coplanar with the plate-holding portion 215 to enable seamless passage of the carrier 214 through the printer.

The hanging element (not shown) of the present embodiment is identical to the hanging element 16 described above, and may be attached to the back face 220 of the metal plate 212 through the cutout opening 244.

Figure 18:
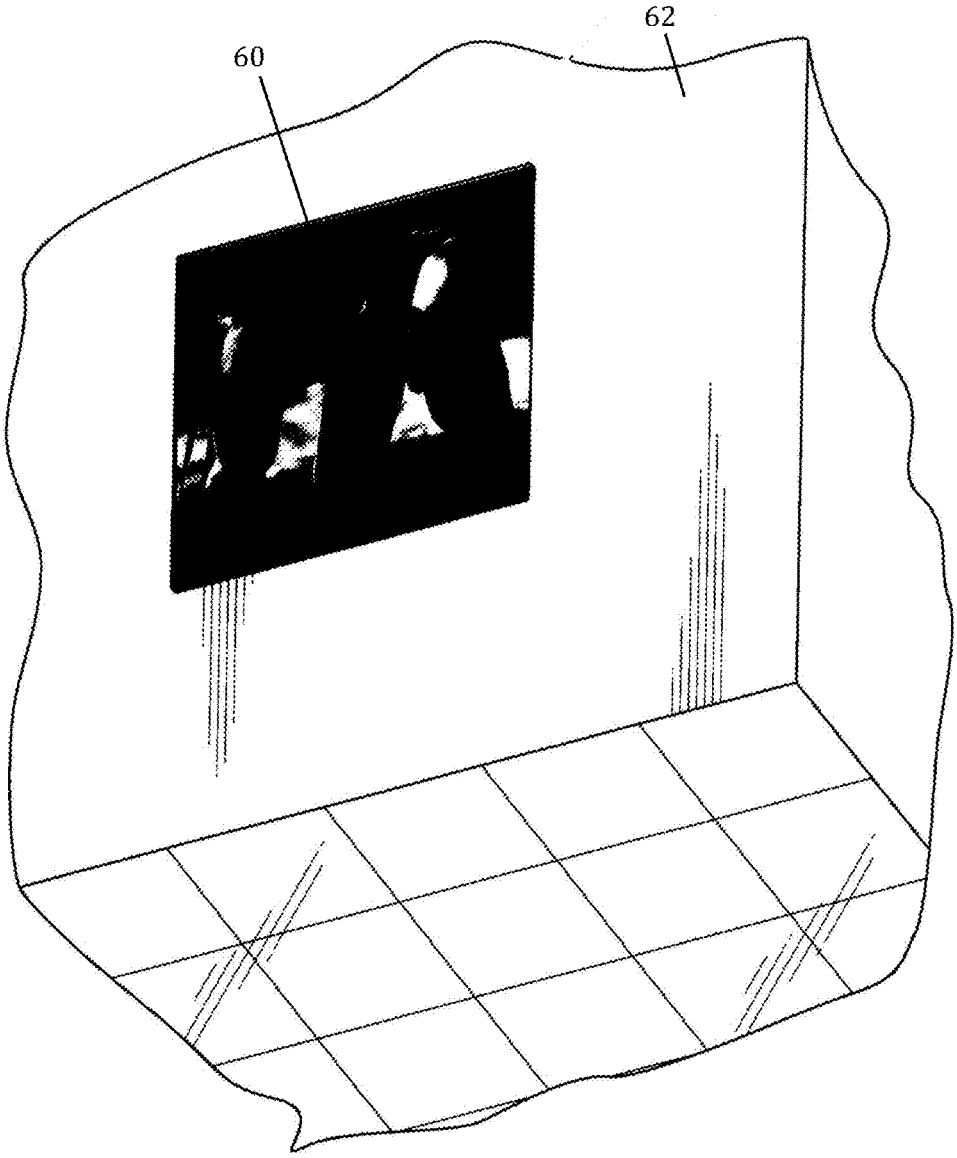
FIG. 18 is a perspective view of a finished picture printed on a printable metal plate hanging on a wall, according to one embodiment of the disclosure.

FIG. 18 illustrates an example of a finished picture 60 on a wall 62. Because the printing has been done such that the printer head prints over the edges of the metal plate 12/112/212, the resulting picture 60 is borderless.

Figure 19:
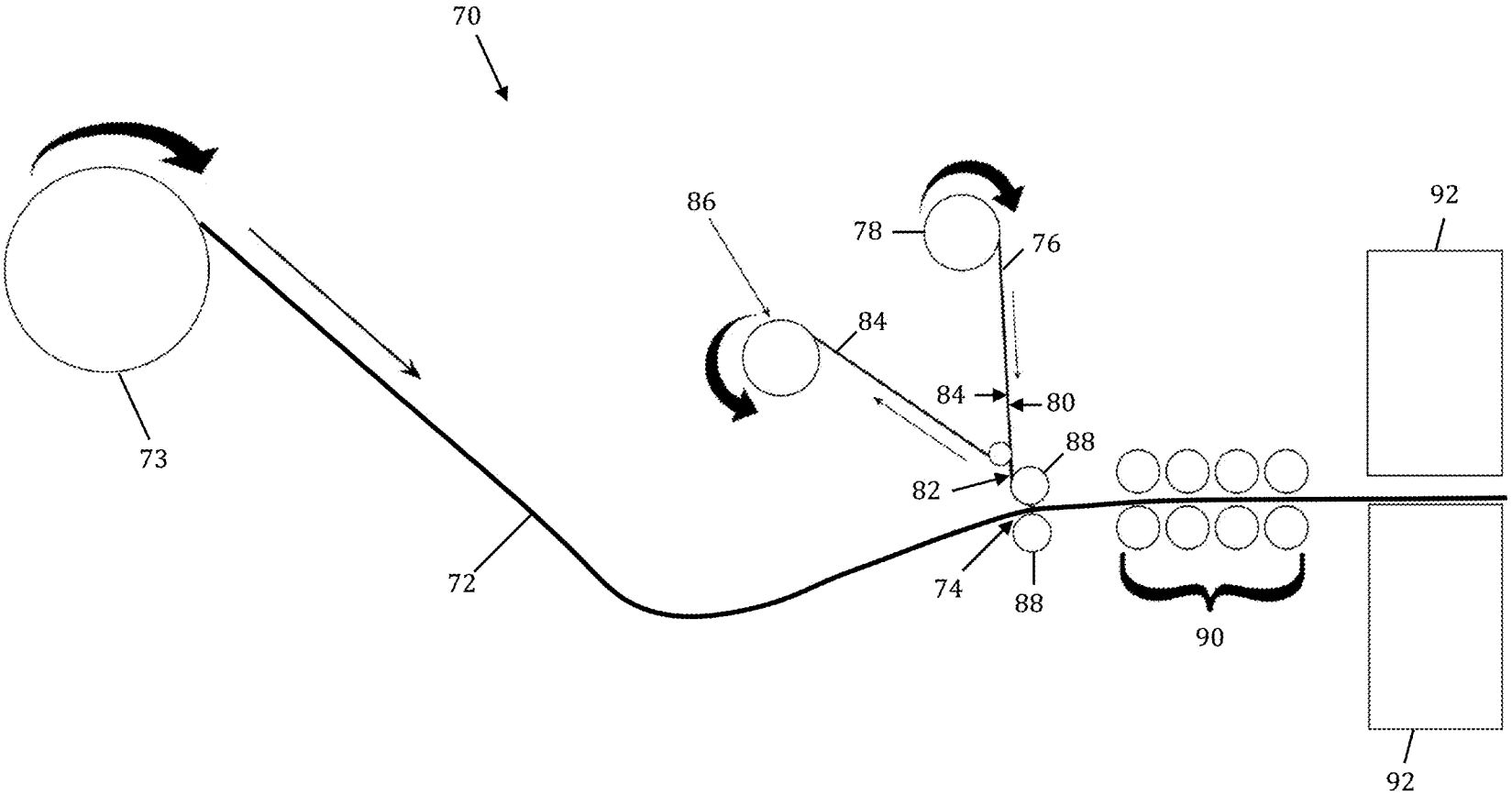
FIG. 19 is a schematic drawing of the process of preparing the printable metal plates for printing, according to one embodiment of the disclosure.

FIG. 19 is a schematic drawing showing an example process 70 by which the metal plates 12/112/212 are prepared according to one embodiment of the disclosure. By way of example, the process 70 begins with a sheet of metal 72 (e.g. aluminum) that is unrolled from a coil 73 and directed to a nip point 74 that crimps a layer of printable film 76 (e.g. the printable film layer 26/126/226 described above) to one surface of the metal sheet 72. The printable film layer 76 originates from a liner roll 78, and has a printable side 80 and an adhesive side 82, which is initially covered with an adhesive cover 84. Prior to crimping with the metal sheet 72, the adhesive cover 84 is removed from the adhesive side 82 and taken in by a release liner uptake coil 86. With the adhesive cover 84 removed, the adhesive side 82 is brought into contact with the metal sheet 72 at the nip point 74 (e.g. between a pair of nip rollers 88) so that the printable film layer 76 can adhere to the metal sheet 72. After the printable film layer 76 and metal sheet 72 are adhered to one another at the nip point 74, the metal sheet 72 passes through a metal flattening machine 90 (e.g. comprising a plurality of roller elements that apply compressive force to the metal sheet 72 with printable film layer 76 to ensure adhesion and also remove potential air bubbles caught between the printable film layer 76 and metal sheet 72. Finally, the individual metal plates 12/112/212 may be stamped out of the metal sheet 72 in a stamping press 92. Once this occurs, the metal plates 12/112/212 are ready to use with the carriers 14/114/214 as described above. With the use of this specialized printable film 76, there is no need for any "final" covering sheet or other process to seal in the ink after the metal plates go through printing process.

Figure 20:
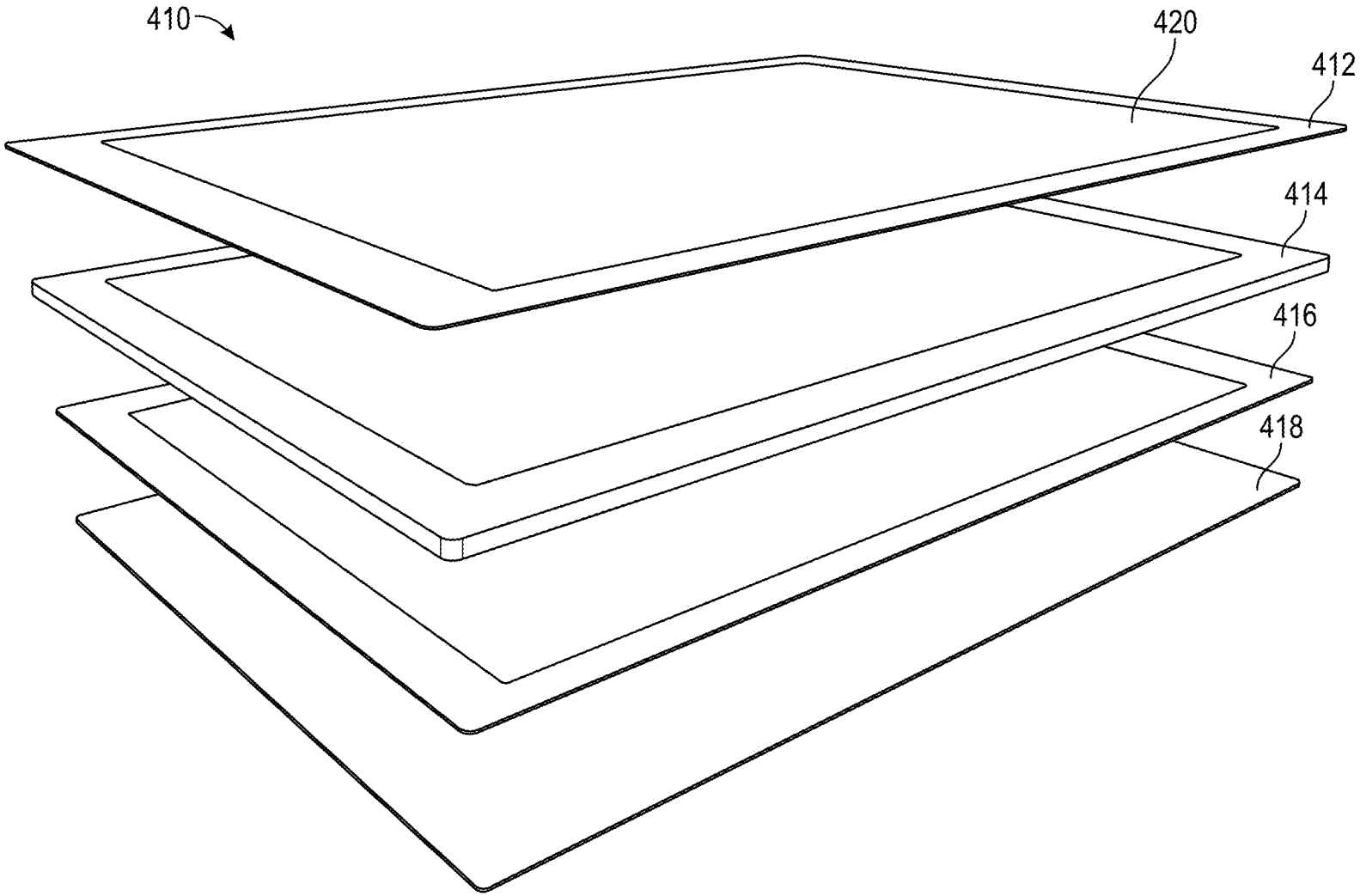
FIG. 20 is a perspective view of an example of a printable template, according to yet another embodiment of the disclosure.
Figure 21A:
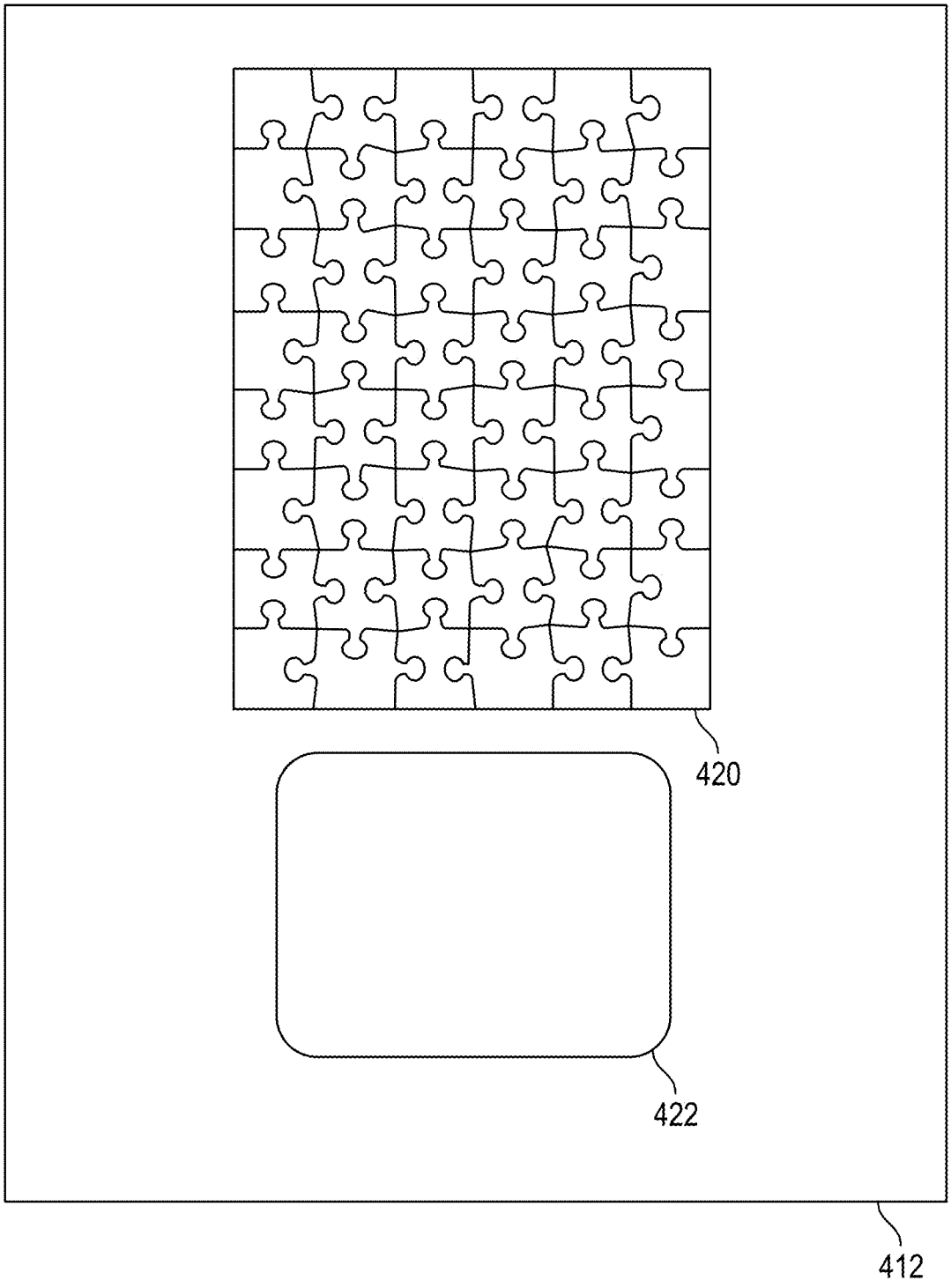
FIG. 21A-21C are different examples of top view of the printing template, according one embodiment of the disclosure.
Figure 21B:
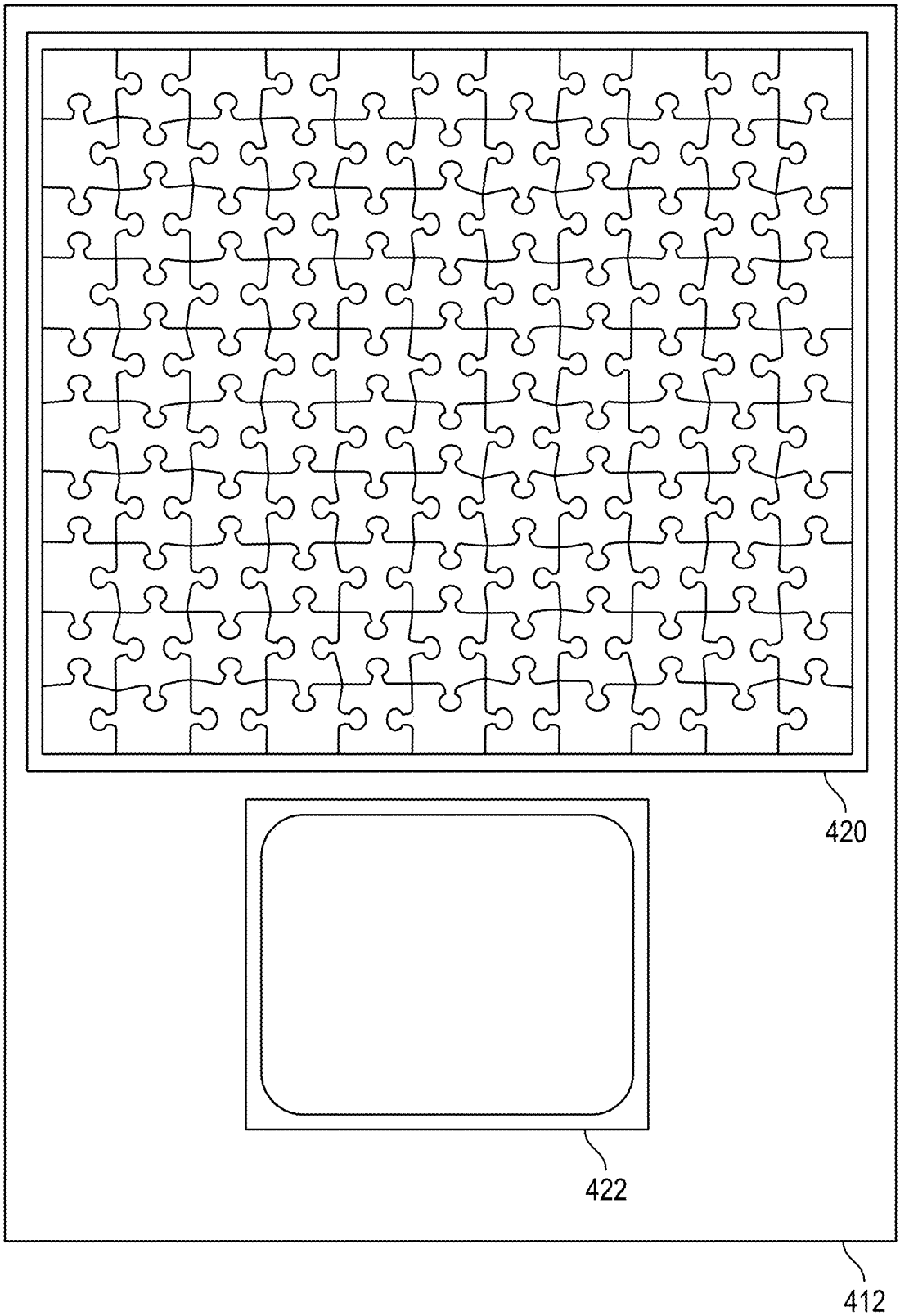
Figure 21C:
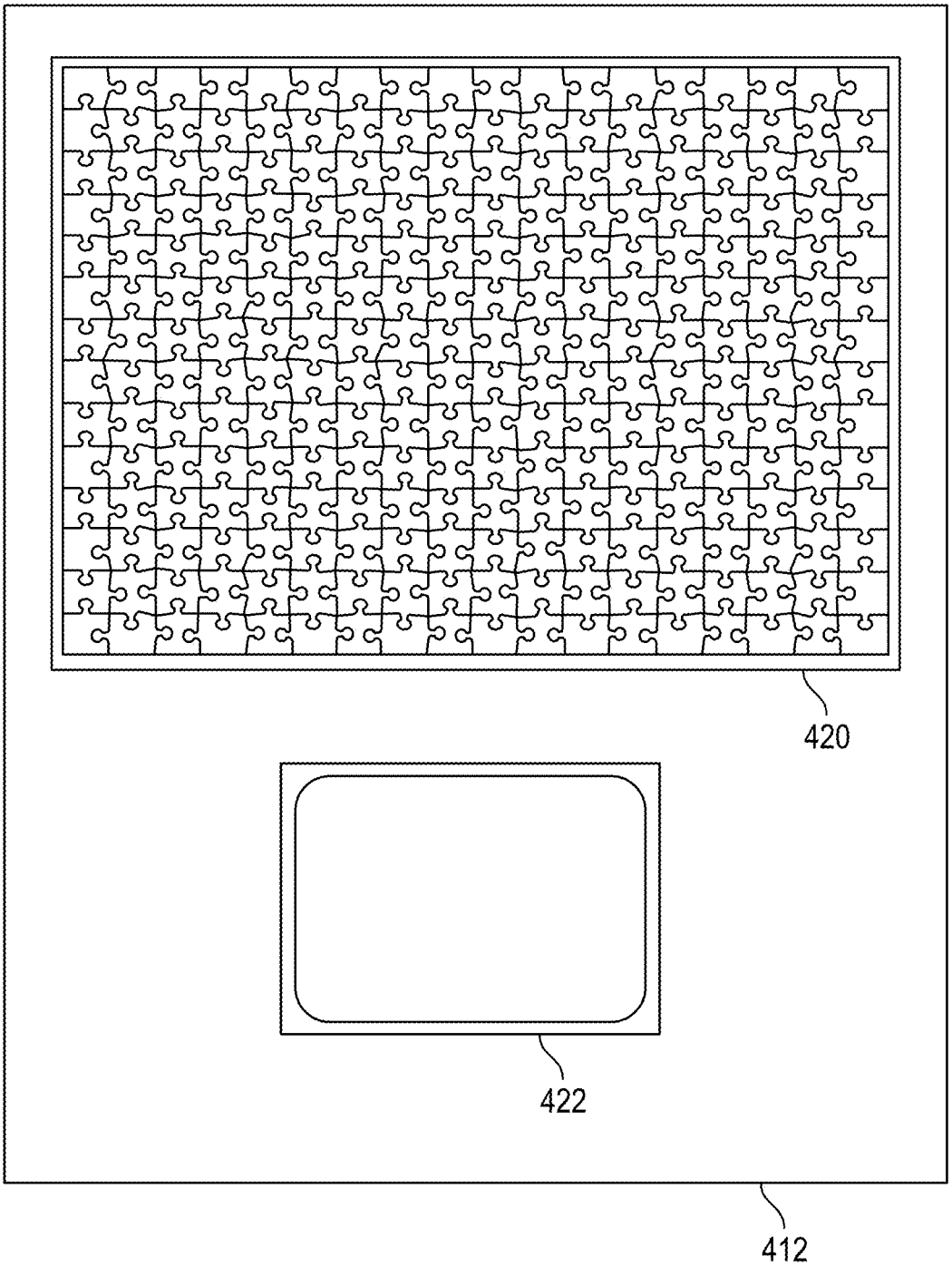
Figure 22A:
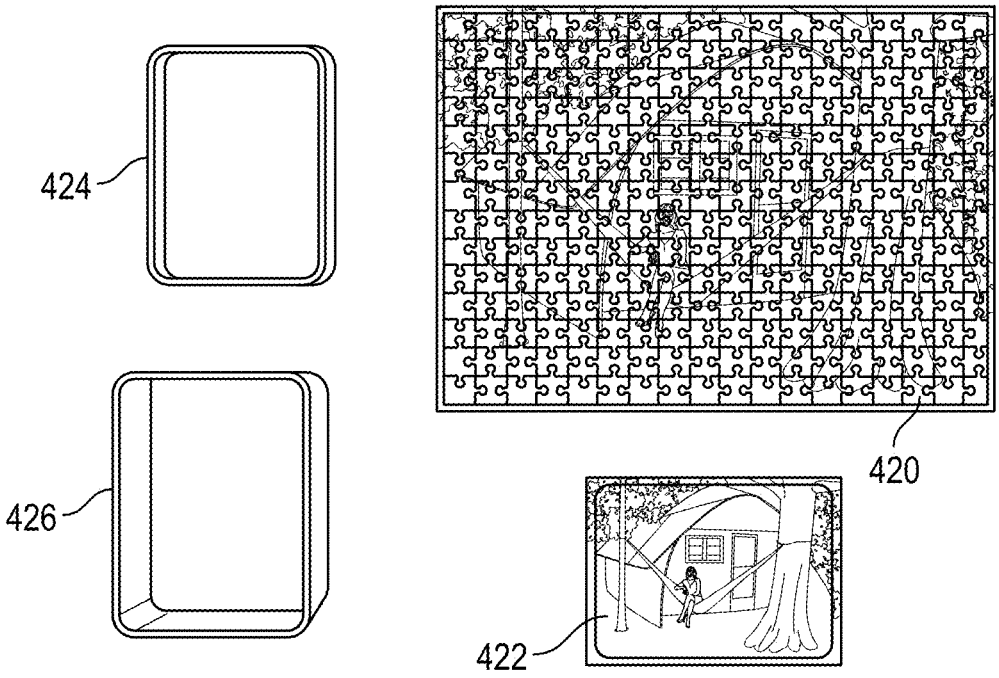
FIG. 22A is an exemplary output of the printing template, according one embodiment of the disclosure.
Figure 22B:
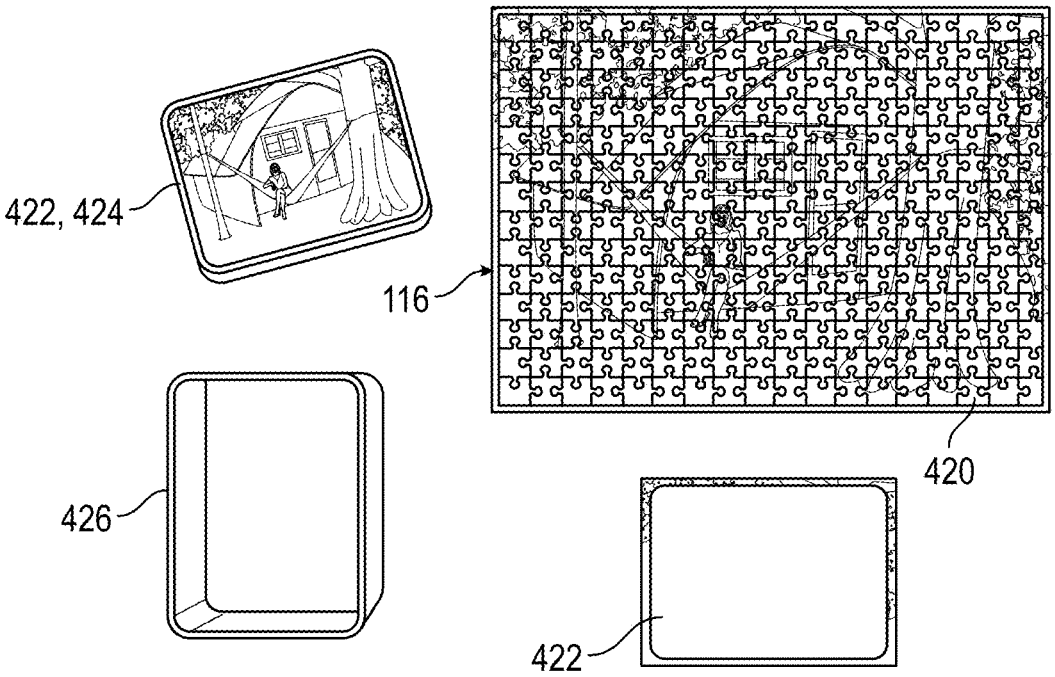
FIG. 22B is an exemplary implementation of the output of the printing template, according one embodiment of the disclosure.

FIGS. 20-22 illustrate a fourth example of a printing template 410 for use in aqueous inkjet printing onto a printing substrate, according to one embodiment of the disclosure. By way of example only, as shown in FIG. 20, the printing template 410 of the instant embodiment includes a printable layer 412, a core layer 414, a silicon release liner 416, and a carrier layer 416.

In the example shown in FIGS. 20-22, the printable layer 412 has a generally rectangular shape having four opposing edges, however it should be understood that the printable layer 412 may have any shape (e.g. circular, oval, triangular, etc.) without departing from the scope of the disclosure.

The front face of the printable layer 412 defines the printable surface. The printable layer 412 may be any material that is capable of accepting aqueous inkjet ink, including but not limited to (and by way of example only) polyester, polyethylene, Mylar, vinyl, PVC, PET, BOTT, polypropylene, polycorbonate, and acrylics. The key to the selection of the printable layer is that it can accept and retain the aqueous ink from an inkjet printer. According to a preferred embodiment, an inkjet ink-retaining microporous coating may be applied on top of the printable layer 412 to enhance the ink retention properties of the printable layer 412. The coating technique can be accomplished (by way of example) with slot die, curtain, gravure or Mayer rod techniques. It should be noted, however, that the key characteristics of the printable layer 412 include, but are not limited to, ink adhesion and retention properties, cost, and optical clarity. With the use of this specialized printable layer 412, there is no need for any "final" covering sheet or other process to seal in the ink after the metal print leaves the printer.

The core layer 414 is having a bottom side removably associated with a top layer of the carrier layer 418. Also, in an example, the core layer 414 has a predetermined thickness and is thicker than other layers of the printing template 410. In other words, the core layer 414 is provided between the printable layer 412 and the carrier layer 418 to just add thickness where necessary (like in case of puzzle manufacturing).

The carrier layer 418 is sized and configured to entirely encompass the shaped perimeter of the printable layer 412. By way of example, the carrier layer 418 has a front face and a back face opposite to the front face. The front face of the carrier layer 418 is coated with an adhesive coating causing the front face of the carrier layer 418 securely associated with the back face of the printable layer 412 or the core layer 414, during the printing process. After the completion of the printing process, the adhesive coating allows easy removal of the carrier layer 418 from the printable layer 412 or the core layer 418.

In an example, a silicon release liner 416 is attached to the bottom side (back face) of the printable layer 412 or the core layer 418 to prevent the carrier layer 418 from bonding permanently or at least too securely to the bottom of the predefined number of parts die cut in the printable layer 412 or the core layer 418. Further, those skilled in the art can appreciate that this layer (silicon release liner 416) is potentially not necessary with very specialized adhesives (which are easily removable).

Although the generally rectangular shape is preferable for the printing template 410 since the carrier layer 418 interacts with the printer and therefore consistency of size and shape is advantageous, nevertheless it should be understood that the carrier layer 418 or the printing template 410 may have any perimeter shape (e.g. circular, oval, triangular, etc.) without departing from the scope of the disclosure, so long as the entire perimeter of the carrier layer 418 is outside of the entire perimeter of the printable layer 412.

Further, as can be seen from FIG. 20, a shape is die cut 420 through the printable layer 412, the core layer 414, the silicon release liner 416, except the carrier layer. Although the shape of the die cut 420 is shown rectangular, other shapes can also be adapted without deviating from the scope of the present disclosure. In examples shown in FIGS. 22A-22C, a predefined number of parts in a desired shape are die cut through the printable layer 412 until the carrier layer 418. In the examples shown in FIGS. 22A-22*c*, the predefined number of parts are categorized in at least two portions 420 and 422, where first portion 420 includes a number of parts die cut in same shape and size, while second portion 422 includes only one-part die cut in the printable layer 412. Although a number of parts die cut in same shape and size in the first portion, the number of parts can be die cut in different shape and size without deviating from the scope of the present matter. For instance, the first portion 420 of example shown in FIG. 22A has 48 parts die cut in same shape. The first portion 420 of example shown in FIG. 22A has 110 parts die cut in same shape. The first portion 420 of example shown in FIG. 22A has 252 parts die cut in same shape. Such examples are used to create a puzzle of a photograph printed on the first portion 420.

Accordingly, the first portion 420 and the second portion 422 defines areas in which the printer fills the printed image. In case of puzzle manufacturing as shown with example in FIGS. 22A and 22B, the first portion 420 is utilized to printing an image to create puzzle die cuts, while the second portion 422 is used for printing a reference image to solve the puzzle. Also, the reference image may be pasted or mounted on a cover 424 of a box 426, which is used to store the puzzle die cuts formed from the first portion 420.

As mentioned above, by changing the die cut shape, the thickness of the core layer 414, the shape of the printable surface, a printed product can be used to make disposable bar coasters, puzzles, board prints where the image is printed to the edge of the board, playing cards, sports trading cards, greeting cards, and so forth.

It should be understood that while preferred embodiments are described in some detail herein, the present disclosure is made by way of example only and that variations and changes thereto are possible without departing from the subject matter coming within the scope of the following claims, and a reasonable equivalency thereof.

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

What is claimed is:

1. A printing template for use during an aqueous inkjet printing process in which ink is transferred onto a printable layer, comprising:

a printable layer having a first side, a second side opposite the first side, and a shaped perimeter, the first side defining a printable surface;

a core layer having a top side securely associated with the second side of the printable layer, wherein the core layer is thicker than other layers of the printing template; and a carrier layer sized and configured to entirely encompass the shaped perimeter of the printable layer, the carrier layer comprising a first side and a second side opposite the first side, the first side including an adhesive coating causing the first side of the carrier layer removably associated with a bottom side of the core layer during the printing process, and is thereafter allowing removal of the carrier layer from the core layer after completion of the printing process, wherein a predefined number of parts in a desired shape are die cut through the printable layer and the core layer up until the carrier layer.

2. The printing template of claim 1, further comprising a silicon release liner attached to the bottom side of the printable layer to prevent the carrier layer from bonding permanently or at least too securely to the bottom of the predefined number of parts.

3. The printing template of claim 1, wherein the predefined number of parts are categorized in at least two portions, and wherein each of the at least two portions is die cut in different sizes.

4. The printing template of claim 3, wherein the printable surface of the printable layer further comprises an inkjet ink-retaining microporous coating applied on top of the printable layer.

5. The printing template of claim 1, wherein the predefined number of parts are categorized in at least two portions, and wherein each of the at least two portions is die cut in same shapes.

6. The printing template of claim 1, wherein the printable layer comprises at least one of polyester, polyethylene, Mylar, vinyl, PVC, PET, BOTT, polypropylene, polycarbonate, and acrylic.

7. A method of printing on a printing template, comprising the steps of:

providing a printing template, wherein the printing template comprising:

a printable layer having a first side, a second side opposite the first side, and a shaped perimeter, the first side defining a printable surface;

a core layer having a top side securely associated with the second side of the printable layer, wherein the core layer is thicker than other layers of the printing template; and a carrier layer sized and configured to entirely encompass the shaped perimeter of the printable layer, the carrier layer comprising a first side and a second side opposite the first side, the first side including an adhesive coating causing the first side of the carrier layer removably associated with a bottom side of the core layer during the printing process, and is thereafter allowing removal of the carrier layer from the core layer after completion of the printing process, inserting the printing template into an inkjet printer;

printing on the printing template such that the printed image fills at least two portions of the printable surface of the printable layer, wherein the at least two portions include a predefined number of parts which in a desired shape are die cut through the printable layer until the carrier layer; and removing the printable layer from the carrier layer so as to remove the at least two portions of the printable surface from the printable layer.

8. The method of claim 7, wherein the printing template comprising a silicon release liner attached to the bottom side of the printable layer to prevent the carrier layer from bonding permanently or at least too securely to the bottom of the predefined number of parts.

9. The method of claim 7, wherein each of the at least two portions is die cut in different shapes and sizes.

10. The method of claim 7, wherein each of the at least two portions is die cut in same shapes and sizes.

11. The method of claim 9, wherein the printable layer comprises at least one of polyester, polyethylene, Mylar, vinyl, PVC, PET, BOTT, polypropylene, polycarbonate, and acrylic.

12. The method of claim 9, wherein the printable surface of the printable layer further comprises an inkjet ink-retaining microporous coating applied on top of the printable layer.

* * * * *